United States Patent [19]

Martini

[11] 4,416,114

[45] Nov. 22, 1983

[54] THERMAL REGENERATIVE MACHINE

[76] Inventor: William R. Martini, 2303 Harris, Richland, Wash. 99352

[21] Appl. No.: 289,043

[22] Filed: Jul. 31, 1981

[51] Int. Cl.[3] ..... F02G 1/04

[52] U.S. Cl. ..... 60/526; 60/517

[58] Field of Search ..... 60/517, 526; 62/6

[56] References Cited

U.S. PATENT DOCUMENTS

| | | | |
|---|---|---|---|
| 3,484,616 | 12/1969 | Baumgardner et al. | 60/526 X |
| 3,692,099 | 9/1972 | Nesbitt et al. | 60/526 X |
| 4,057,962 | 11/1977 | Belaire | 60/526 |

*Primary Examiner*—Allen M. Ostrager

*Assistant Examiner*—Stephen F. Husar

*Attorney, Agent, or Firm*—Wells, St. John & Roberts

[57] ABSTRACT

An improved heat exchange assembly for a thermal regenerative machine such as a Stirling cycle engine or heat pump. It includes a sandwiched structure having a center regenerator layer between first and second thermal conductor layers. The regenerator has poor longitudinal thermal conductivity. The outside thermal conductors have good longitudinal heat conduction and sufficient heat storage capacity to supply or absorb the quantity of heat which is transferred between it and the gaseous working fluid of the machine during each cycle of machine operation.

7 Claims, 7 Drawing Figures

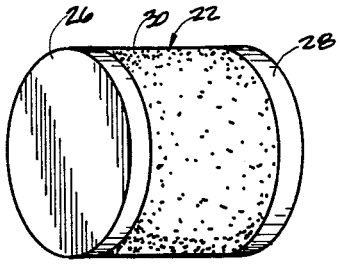
FIG 1
FIG 2
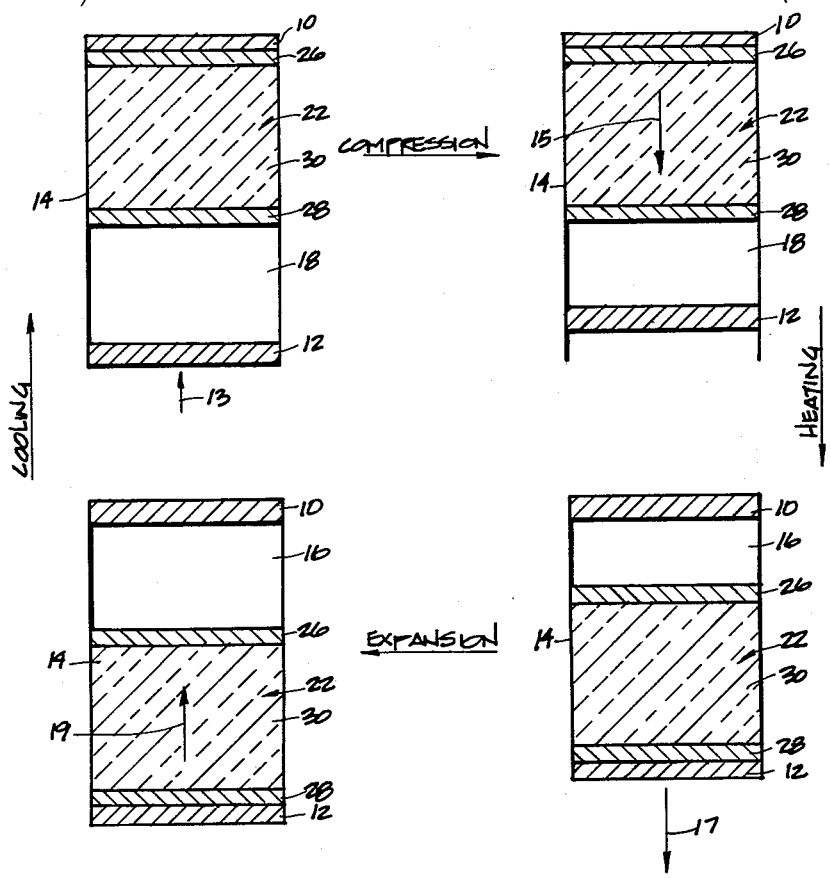

THERMAL REGENERATIVE MACHINE

TECHNICAL FIELD

This invention relates generally to thermal regenerative machines, and more particularly to Stirling cycle engines or heat pumps.

BACKGROUND ART

As is well-known, there are two main types of Stirling cycle thermal machines. These are the double cylinder, two piston type and the single cylinder, piston and displacer type. Each of these types has two working spaces filled with the working fluid and connected by a duct which includes fixed regenerator and heat exchangers therein. The working spaces are at the different extreme temperatures of the working cycle and one space is for expansion of the working fluid or gas while the other space is for compression thereof. The two pistons of the double cylinder type are connected by suitable linkages to a crankshaft at which power input is provided or power output is derived. The crankshaft and linkages maintain a proper phase relationship between the two pistons such that their respective working spaces are appropriately varied in volume approximately in conformance with the Stirling thermodynamic cycle.

Similarly, the piston and displacer of the single cylinder type are connected by suitable linkages to a crankshaft where power input is supplied or power output is delivered. The crankshaft and linkages of the single cylinder type also maintain a proper phase relationship between the piston and displacer such that the expansion and compression spaces respectively at the two ends of the single cylinder are appropriately varied in volume according to the Stirling cycle. The piston alternately compresses and expands the working fluid as the displacer, which separates the working spaces, synchronously shifts the working fluid through the regenerator and heat exchangers back and forth between the connected spaces. The movement of the displacer is timed to place most of the working fluid in the compression space when the piston makes its compression stroke, and most of the fluid in the expansion space during its expansion stroke. The Stirling cycle has the same efficiency as the well-known Carnot cycle for the same operating temperature limits but differs from the latter cycle in that the two adiabatic lines thereof are replaced by two constant volume lines.

The Stirling cycle is a thermodynamic cycle wherein a fluid or gas alternately undergoes constant volume and constant temperature processes and in which the heat-up and cool-down of the gas is done at constant volume by a thermal regenerator. This cycle has Carnot cycle efficiency. The Ericsson cycle is similar to the Stirling cycle except that the heat-up and cool-down of the gas is done at constant pressure by the regenerator. This cycle also has Carnot cycle efficiency.

The real engine with a mechanical linkage that places the two pistons, or the piston and displacer, in simple harmonic motion 90 degrees out of phase with each other rounds the corners of the idealized thermodynamic cycles mentioned above. In the real engine, the heat-up and cool-down of the gas is actually done at changing volume and pressure by a regenerator. Nevertheless, if it assumed that the regenerator is perfect and heat transfer to and from the gas is perfect, then this engine, loosely called a Stirling cycle engine, also has Carnot cycle efficiency.

The original Stirling engine design was starved for heat exchange surface. As the gas moved back and forth it never attained either the heat source or heat sink temperature, so the potential power attainable was not obtained. For many years the original design by Robert Stirling was little improved upon. The regenerator screen was usually removed which decreased the internal flow losses at the expense of decreased heat transfer capability but with a net gain in performance.

Two early developers hit upon the isothermalizer principle to eliminate heat transfer starvation in their engines. One was Napier and Rankine who built in about 1854 an engine in which the heater was part of the hot space and the cooler was part of the cold space. These heat exchangers were bundles of closed end tubes with rods fitting down into each tube to displace the gas. For its time it was a very advanced design. To my knowledge, there is no record of how it worked. In 1874 it was reported that several cooling engines had used nesting cone isothermalizers.

Since 1875 the history of designers who have chosen the isothermalizer tradeoff has been quite sparse. The Newton U.S. Pat. No. 2,803,951 describes refrigerating compressors using a finned cone isothermalizer. Dineen U.S. Pat. No. 3,220,178 used meshed fins in an air engine built for the U.S. Army.

Although the isothermalizer idea is old, the reasons it has not been more popular in Stirling engine design are:

1. It is usually more expensive to build.
2. It is necessary only for machines operating over a small temperature difference.
3. Good performance can be realized without it.

The mainstream of Stirling engine development from the original engine has been by increasing the surface area of the flow-through heater, regenerator and cooler. Only small, low pressure Stirling engines such as are used in the artificial heart can reasonably employ a single annulus to act as a heater, regenerator and cooler in different parts of the annulus. Larger Stirling engines regularly use fins or tube bundles in the heater and cooler and stacked screens or knitted steel wire in the regenerator. It is easy to design the engine heat exchangers so that heat transfer is very good, but flow friction is so high that all the power is consumed in internal flow friction. It is also easy to design the heat exchangers with negligible flow friction but with inadequate heat transfer. Furthermore, one is not free to build big heat exchangers with adequate heat transfer and acceptable flow loss as is possible in steam engines or in gas turbines. In these machines extra large heat exchangers add to the cost and marginally improve power output and efficiency. On the other hand, in a Stirling engine extra large heat exchangers add to the cost and may increase or decrease efficiency, but always greatly reduces the power output. This effect is the inevitable result of not having valves or pumps as are used in Rankine or Brayton cycle machines. Dead volume in a Stirling machine decreases the pressure change that is possible for a given volumetric displacement and therefore reduces power output capability.

Dead volume is always needed for the regenerator. A regenerator is needed for good efficiency. Some type of matrix is needed with low longitudinal thermal conductivity. During half the cycle heat is being transferred into the matrix at each point. During half the cycle heat is being transferred back out. The matrix must have adequate heat capacity so that its temperature does not change appreciably during a cycle. There must be a large surface for heat transfer so that at each point as the gas moves through the matrix only a small temperature difference exists. The flow area must be large enough so that flow resistance is small without heat conduction becoming too large.

For the usual flow-through type of heater and cooler, dead volume is also needed. For flame heating the size of the heater is controlled by the flame-side heat transfer area. A heat pipe heated gas heater is better because it is much smaller because the working gas side surface is controlling. Tubes are usually used because the heat fluxes are high and temperature drop through the wall is manageable. Fins are cheaper but the temperature drop along the fins must not be neglected. Gas coolers are usually made from a very large number of tiny tubes with the water in cross flow. The cooler, and especially the heater, are costly parts of the Stirling engine. A number of concepts are now being tested to simplify the design and reduce the cost of the materials. The subject of this disclosure is an entirely new way to build the gas heater and cooler which appears simpler and cheaper than present methods. This new way lends itself to very large flow areas, which makes it possible to use air as a working fluid with little penalty.

DISCLOSURE OF INVENTION

This disclosure relates to a thermal regenerative machine, which can be either an engine or heat pump. It includes a vessel chamber filled with a gaseous working fluid. The chamber has a heat source surface at one end, a heat sink surface at its remaining end, and a sidewall connecting its ends. A porous heat exchange assembly defines an expansion space and a compression space which are located adjacent to the heat source surface and the heat sink surface, respectively. Various mechanical, hydraulic, pneumatic or electrical devices can be used for cyclically varying the volumes of the expansion space and compression space, as in the well known Stirling cycle.

The porous heat exchange assembly includes first and second thermal conductors in the form of outer layers which face toward the heat source surface and heat sink surface, respectively. The first thermal conductor receives and stores heat from the heat source surface and supplies the stored heat to gas either passing through it or located in the expansion space. Similarly, the second thermal conductor transfers heat to the heat sink surface and absorbs heat from the gas either passing through it or located in the compression space. The porous heat exchange assembly is completed by a regenerator interposed between the two thermal conductors. It thermally insulates them from one another and allows the working gas to move back and forth between them in a substantially thermodynamically reversible manner. The structure of the first thermal conductor is such that its heat storage capacity is adequate to supply the quantity of heat required by the working gas in the expansion space for one cycle without a substantial change in the temperature of the thermal conductor. Similarly, the heat storage capacity of the second thermal conductor is adequate to absorb the quantity of heat produced by the working gas in the compression space for one cycle without a substantial change in the temperature of the second thermal conductor.

It is a first object of this invention to provide a new method of transferring heat inside a thermal regenerative machine. This is accomplished through use of the novel heat exchange assembly as broadly defined above. In an exemplary engine embodying the invention, the heat of expansion is supplied to the working gas from both the heat source surface and the surfaces of the first thermal conductor in the porous heat exchange assembly. In the compression space, the heat of compression is absorbed by both the heat sink surface and the surfaces of the second thermal conductor in the heat exchange assembly. The central regenerator section of the heat exchange assembly thermally insulates its hot and cold end layers. Most of the heat supplied to the gas in the expansion space is transferred to the first thermal conductor and then is transferred to the gas. The same action occurs with respect to transfer of heat from the working gas in the compression space.

Another object of this disclosure is to produce a new machine which can use cheap working fluids such as air with less penalty, can operate at high speeds, has a high power density, is compact and has high operating efficiencies, even though not quite as high as those of an isothermalized machine.

These and further objects will be evident from the following disclosure. The disclosure discusses the general nature of the invention and includes specific examples showing the manner by which the invention would be incorporated into practical machines. It is to be understood that the disclosure relates only to the internal transfer of heat within the machine. The equipment and systems required for external heat transfer and for moving the parts of the machine are well known and can take any form common to this general class of thermal regenerative machines.

DESCRIPTION OF THE DRAWINGS

FIG. 1 is a side view of the present heat exchange assembly;

FIG. 2 is a schematic representation of the machine's operating cycle;

BEST MODE FOR CARRYING OUT THE INVENTION

Figure 3:
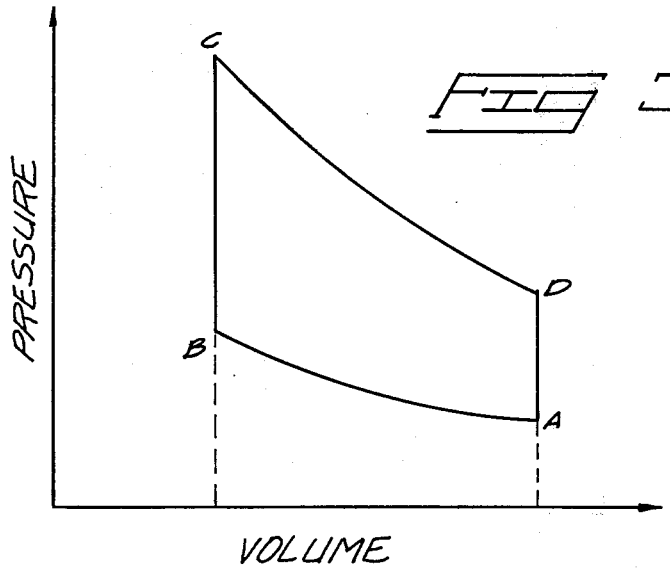
FIG. 3 is a graphic repesentation of the Stirling cycle.

My present invention pertains generally to thermal regenerative machines, and specifically both to the field of Stirling engines as well as to the field of Stirling cycle cooling machines. In both of these fields the machine works by compressing and expanding a gas that is all nearly at the same pressure at each instant of time. However, compression is made to take place mainly in one part of the engine which gives off heat. Expansion is made to take place mainly in another part of the engine where heat is absorbed. As the gas moves from the compression space to the expansion space and back during the thermodynamic cycle, it usually passes through a regenerator to conserve the sensible heat in the gas.

In the art, there are two basic ways of moving the working gas. In the first way, two pistons can be used which act 90 degrees out of phase with each other to properly transfer the gas and also expand and compress it. In the second way, a displacer moves the gas from the expansion space to the compression space and back and the power piston compresses and expands the working gas. If the expansion space is at a lower temperature than this compression space, mechanical energy must be supplied and the machine is a heat pump. If the expansion space is at a higher temperature, mechanical energy is produced each cycle and the machine is a heat engine. My invention can be used in both these types of machines.

No matter how the Stirling cycle machine is being used, heat is absorbed and gas is cooled as the working gas expands. Heat is given off and gas is heated as the working gas is compressed. The highest theoretical efficiency is obtained when the working gas temperature varies very little from that of the solid wall surrounding it during the cycle. It is especially necessary to isothermalize all gas spaces when the temperature ratio over which the engine works is small. In the limit with very good gas-to-solid heat transfer and very poor heat conduction and very low flow resistance, the efficiency of the Stirling machine approaches the limiting thermodynamic efficiency which is usually called the Carnot efficiency. Although isothermalizers have been used in these machines, they have never been popular because they have been expensive to make. An isothermalizer is any structure which keeps all parts of the gas in close proximity to a solid surface. In addition the isothermalizer must be able to transfer heat through the solid to or from all parts of the gas. My invention can be used as part of an isothermalizer structure. Although theoretically the isothermalized machines would be the most efficient when all losses are considered, the gain in having the variable volume spaces of the machines be isothermal is in most cases more than offset by heat conduction and other losses, and by the extra cost.

If heat is not transferred to the working gas while it expands and contracts, it must be transferred as the gas flows. Essentially all current Stirling engines use heaters and coolers made up of many small tubes or fins which can heat or cool the gas adequately as it flows without adding too much dead volume and too much flow resistance. The cost of these structures is also high because the designers usually want to use large numbers of very small tubes. They would like to use an even larger number of small tubes each with a shorter length, but it is difficult to arrange the heat transfer on the non-working gas side of the heat exchangers. That is, in an engine the flame heat transfer coefficient is controlling in the heater and the water heat transfer coefficient is controlling in the cooler. In addition there is the problem of practically connecting the parts even if higher heat transfer coefficients as available in heat pipes are used.

The regenerator material now most popular is made from stacks of very fine wire screens. This material has been found to be quite expensive. Substitutes like foam metal and knitted wire bodies are being used in some engines. However, the cheapest material that would be satisfactory is a bed of evenly-sized spheres. If these spheres are made from glass or ceramic or a mineral like quartz they would have a low thermal conductivity. As a further refinement, hollow glass spheres are available and would further reduce thermal conductivity. However, this least expensive regenerator material does not fit well into the usual Stirling engine design because the flow area would have to be too large and the thickness of the regenerator would have to be too small and the heat conduction down the walls of the regenerators would be too great.

My invention solves the problem of making efficient and inexpensive heaters and coolers and of using the most inexpensive regenerator material at the same time by making a basic change in the way Stirling machines are designed.

The central feature of this invention is the porous heat exchange assembly 22 illustrated in FIG. 1 and shown schematically in FIG. 2. FIG. 2 illustrates the operation of a heat engine or "Stirling" cycle engine incorporating the present invention. The discussion which follows pertains to the application of the invention to a heat engine. It is to be understood that the invention is equally applicable to heat pumps utilizing operating cycles such as the Stirling cycle. In a heat pump, the references to the relative temperatures of the machine elements as being driving or driven members and heaters or coolers would be interchanged.

The heat exchange assembly 22 is composed of three elements: a first thermal conductor 26, a second thermal conductor 28, and an intermediate porous regenerator 30. In the case of an engine as exemplified by the flow diagram in FIG. 2, the first thermal conductor 26 could be termed a "heater" and the second thermal conductor 28 could be termed a "cooler."

The first and second thermal conductors 26 and 28 each comprise a structure having a high surface-to-volume ratio to facilitate heat transfer between it and the gaseous working fluid within the engine. Each must also be made from a material having good longitudinal thermal conductivity oriented between the ends of the vessel chamber in which it is used, and should have evenly distributed porosity and low gaseous flow resistance. It also must have adequate heat capacity. Sintered or perforated metallic structures made from heat-conductive materials such as copper or aluminum would be suitable for use in the construction of the first and second thermal conductors 26 and 28. By using structures produced from sintered spheres, the flow passages for transfer of heat from or to the working gas can be smaller, shorter and more numerous than is possible in the conventional heat exchangers that have been used in existing machines of this type.

The regenerator 30 comprises a porous structure also having a high surface-to-volume ratio to facilitate heat transfer between it and the gaseous working fluid. However, it should be made from a material having poor longitudinal thermal conductivity between the first and second thermal conductors 26 and 28. The material should have evenly distributed porosity and low gaseous flow resistance. As an example, regenerator 30 might be made from closely packed ceramic spheres or microspheres, which can be either solid or hollow. The intermediate layer of ceramic spheres fills the space between the first and second thermal conductors 26 and 28. Such a structure can be designed to have a much larger flow area than is normal in this type of machine.

The three layers 26, 28 and 30 that comprise the heat exchange assembly are intimately fixed to one another as an integral unit. The first and second thermal conductors 26 and 28 form outside layers of a sandwich having the regenerator 30 at its center.

A thermal regenerative machine incorporating the three layer heat exchange assembly and operating according to the Stirling cycle as an engine is schematically illustrated in FIG. 2. Such a machine comprises an interior vessel chamber which includes a heat source surface 10 at one end, a heat sink surface 12 at its remaining end, and a side wall 14 connecting its two ends. The vessel chamber is an enclosed space holding a fixed volume of gaseous working fluid. The gaseous working fluid can be air, or can be a suitable gas such as helium or hydrogen. The normal pressure of the gaseous working fluid can be at any suitable pressure compatible with the strength properties of the vessel chamber, depending upon desired machine capabilities and efficiencies.

The porous heat exchange assembly comprised of the first and second thermal conductors 26 and 28 plus regenerator 30 is located within the vessel chamber. It defines an expansion space 16 within the vessel chamber adjacent to the heat source surface 10 and a compression space 18 adjacent to the heat sink surface.

The machine also includes means for cyclically varying the volumes of the expansion space 16 and compression space 18 so as to alternately expand the gaseous working fluid in the expansion space and compress the gaseous working fluid in the compression space and to further move the gaseous working fluid back and forth between the expansion space 16 and compression space 18 through the porous heat exchange assembly. A variety of mechanical, hydraulic, pneumatic and electrical devices have been used in the past for achieving this purpose in predecessor thermal regenerative machines. The present invention can be applied to any such machine designs, and the details of these external operating devices are unnecessary for an understanding of the present invention. By way of example, specitic physical embodiments are illustrated in FIGS. 4 through 7 and are described below.

As can be seen in FIG. 2, the first thermal conductor 26 faces outwardly toward the heat source surface 10 within the vessel chamber. It is adapted to receive heat by conduction and radiation when near the heat source surface 10. It supplies heat by convection and radiation to the gaseous working fluid either passing through the first thermal conductor 26 or located in the expansion space 16. Similarly, the second thermal conductor 28 faces outwardly toward the heat sink surfce 12. It transfers heat by conduction and radiation when near the heat sink surface 12. It absorbs heat from the gaseous working fluid either passing through the second thermal conductor 28 or located in the compression space 18.

The compression stroke, in a single piston engine, begins with movement of the heat sink surface 12 in the direction shown by arrow 13, which leads to the condition illustrated in the upper right hand corner of FIG. 2. In this condition, the working gas is compressed. Some of the gas originally in the compression space 18 has entered the pores of the second thermal conductor 28 or cooler, and the regenerator 30. During the compression step the heat exchange assembly absorbs the heat of compression of the gas, but the thermal conductor 28 changes temperature very little because its heat capacity is much larger than the gas heat capacity. Since there is no substantial change in the temperature of the second thermal conductor 28, the resulting heat absorption is essentially isothermal.

During compression generally, the gas in the compression space 18 transfers only a minor fraction of its heat of compression to the heat sink surface 12 and the cooler layer or second thermal conductor 28. Therefore, the temperature of the working gas within the compression space 18 increases in temperature. This combination of isothermal and near adiabatic compression results in an increased pressure in the working gas. This process is represented by line AB on FIG. 3.

The heating step of the cycle occurs during movement of the heat exchange assembly in the direction shown by arrow 15. The resulting shift in position of the heat exchange assembly is shown in the lower right hand corner of FIG. 2.

The total volume of working gas remains constant during the heating step. Because of the movement of the heat exchange assembly, the volume of the compression space 18 decreases to almost zero, and the volume of the expansion space 16 becomes appreciable. Almost none of the gas in the compression space 18 reaches the expansion space 16 since the dead volume within the heat exchanger assembly is too large to permit its passage. As the heat exchange assembly moves during this process, relative to the working fluid or gas, gas coming from the compression space 18 to the cooler layer presented by the second thermal conductor 28 is reduced in temperature. Gas moving through the regenerator 30 is gradually warmed as it flows through its porous structure. Heating of the gas is completed in the heater layer presented by the first thermal conductor 26 and enters the expansion space 16.

During the heating step, more gas is heated than is cooled. Therefore, the pressure within the vessel chamber increases (line BC in FIG. 3). A longitudinal force moves the heat sink surface 12 in the direction shown by arrow 17. This initiates the expansion portion of the machine cycle. At the end of the heating step, the gas temperature in the expansion space 16 is usually higher than that of the heat source surface 10.

The completion of the expansion portion of the cycle is illustrated at the bottom left hand corner of FIG. 2. All of the working gas within the vessel chamber expands, including the gas in the expansion space 16 and the gas in the heat exchange assembly. During the process, gas flows from the heat exchange assembly into the expansion space 16. Generally the gas in the expansion space expands nearly adiabatically and gas in the heat exchange assembly expands isothermally at all the various temperature levels. The expansion is shown by line CD on FIG. 3. During this step, the temperature of the gas in the heat exchange assembly is little affected because of the heat capacity of the first thermal conductor 26 or heater layer and the high heat transfer coefficiency of the materials involved. However, gradually the temperature of the gas in the expansion space 16 becomes less than that of the heat source surface 10.

During the cooling step, the heat exchange assembly moves in the direction shown by arrow 19. No change occurs in the working gas volume. As the heat exchange assembly moves, gas entering the first thermal conductor or heater layer from the expansion space 16 is heated. However, generally gas displaced by this movement is cooled. In a similar manner as in the heating step, the overall effect is cooling of the working gas. This causes a reduction in pressure with no volume change as indicated by line DA in FIG. 3. In a manner analogous to the heating step, the temperature of the gas in the compression space 18 is generally lower than that of the heat sink surface 12.

The apparatus that imparts movement to the heat exchange assembly during the cooling step shown to the left in FIG. 2 must include means for causing the first thermal conductor 26 to touch or nearly touch the heat source surface 10 for a dwell time sufficient to cause the two to equilibriate in temperature and to restore to the first thermal conductor 26 the net heat loss to the gaseous working fluid which occurs during each machine cycle. Similarly, during the heating step shown to the right in FIG. 2, it includes means for causing the second thermal conductor 28 to touch or nearly touch the heat sink surface 12 for a dwell time sufficient to cause the two to equilibriate in temperature and to transfer from the second thermal conductor 28 the net heat gain from the gaseous working fluid which occurs during one cycle.

It is important to note that the heat storage capacity of the first thermal conductor 26 must be adequate to supply the quantity of heat required by the gaseous working fluid in the expansion space 16 for one cycle of operation without substantial change in the temperature of the first thermal conductor 26. Similarly, the heat storage capacity of the second thermal conductor 28 must be adequate to absorb the quantity of heat produced by the gaseous working fluid in the compression space for one cycle of operation without substantial change in the temperature of the second thermal conductor 28.

Calculations of machine operation were conducted on a computer model to evaluate projected engine efficiencies. The calculations assumed a common pressure at each instance of time. It used three gas nodes—the hot space, the regenerator space, and the cold space. It used three solid nodes—the heater layer or first thermal conductor 26, the regenerator 30, and the cooler layer or second thermal conductor 28. No node was assumed to be either isothermal or adiabatic, but realistic heat transfer rates were computed and used for each node and for each time step. Specifically, the assumptions used in the mathematical model were as follows:

1. The perfect gas law applies.
2. No leakage occurs into or out of the working gas space.
3. The pressure is the same throughout the engine at each time step.
4. True flow friction is very nearly the same as that calculated from the mass flows derived from Assumption 3.
5. Indicated power is the computed pressure-volume integral times the engine speed less the flow friction.
6. Hot plate and cold plate temperature are fixed.
7. Heater and cooler layer temperatures float based upon a heat balance over one cycle.
8. The regenerator effective temperature can be made the log mean of the heater and cooler layer temperatures and the heat balance in the regenerator can be ignored.
9. The regenerator matrix has a linear temperature gradient.
10. Perfect mixing occurs in both the hot space and the cold space.
11. The temperature distribution of the gas in the regenerator is linear.
12. Gas-solid heat transfer in the heat exchanger assembly obeys the correlations for steady flow.
13. Gas-solid heat transfer in the hot and cold spaces obeys known correlations developed for thermal regenerative machines.
14. Positions of the displacer-regenerator and the power piston are specified with time.
15. Shuttle heat conduction and steady thermal conduction are additive to the other heat transfer processes.

A simulation program was developed which displayed the engine operation graphically. Changes in either dimensions or operating conditions could be made easily.

An optimization program was also written which searched through all combinations of displacer length, regenerator matrix sphere diameter, and displacer stroke to find the best efficiency engine that has the target power at less than the engine pressure limit. In each case the engine pressure was adjusted to attain the target power so that all design possibilities were compared at the same output power.

Some representative calculated results will now be given and then a comparison will be made with a conventionally designed engine.

Figure 7:
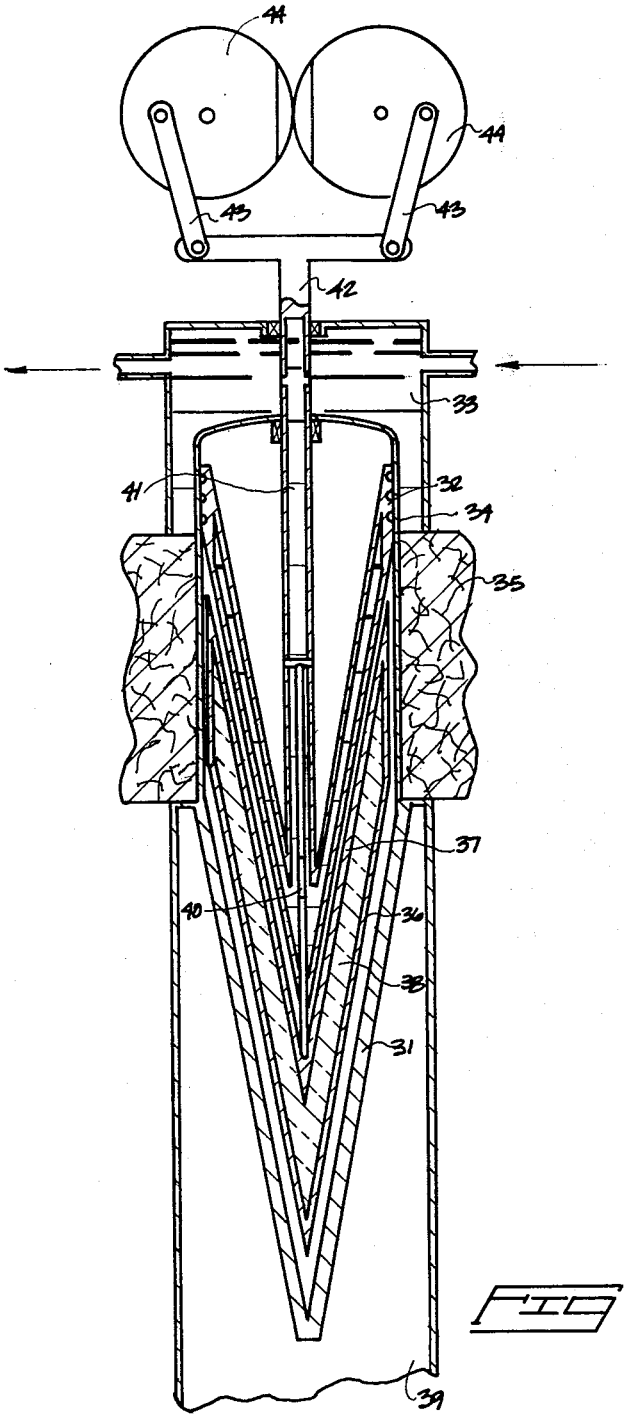
FIG. 7 is a schematic sectional view of a nesting cone engine embodiment.

A nesting cone heat engine schematically shown in FIG. 7 was analyzed for optimal results. The design was optimized for helium as the working gaseous fluid, because of the heat pipe heating system that would be employed in the engine.

As shown in FIG. 7, the vessel chamber comprises a conical stationary hot plate 31 and a longitudinally movable conical cold plate 32. External heat is applied to hot plate 31 by a heat pipe 39. The cold plate 32 is water cooled. Water entering the movable cold plate 32 is received through a surrounding water jacket 33 at the cool end of the engine. The side walls or cylinder walls 34 are insulated at 35.

Located within the vessel chamber intermediate the conical hot plate 31 and cold plate 32 is a conical porous heat exchange assembly, which serves as a displacer-regenerator as described above with respect to FIG. 2. It includes a heater layer 36, a cooler layer 37 and a regenerator layer 38. The materials utilized in these individual layers have been previously identified. The displacer-regenerator is shiftable longitudinally relative to the cold plate by a selectively operable displacer drive 40 arranged between cold plate 32 and the displacer-regenerator. The displacer drive 40 can be hydraulic, or pneumatic, or can be an electric solenoid, or possibly a combination of such devices.

The hollow axial shaft 41 which protrudes from the cold plate 32 is connected to an output shaft 42 which is bifurcated to linkages 43 that individually power two cranks 44 arranged in a Cartwright linkage. This known form of mechanical engine output can then be used to drive any suitable device requiring the power of the engine.

The operating conditions employed for calculation purposes were:

| | |
|---|---|
| Mean Gas Pressure, psia | 2000 |
| Hot Plate Temperature, F. | 1160 |
| Cold Plate Temperature, F. | 152 |
| Engine Speed, rpm | 1800 |
| Phase Angle, degrees | 90 |
| Mechanical Efficiency, % | 90 |
| The engine dimensions are given as follows: | |
| Piston diameter, cm | 20 |
| Sphere dia. of Matrix, cm | 0.027 |
| Displacer Stroke, cm | 4.375 |
| Displacer Length at c.l., cm | 26.802 |
| End Clearance, cm | 0.020 |
| Gap between Displ. and Cyl. W., cm | 0.020 |
| Ratio of Cone Height to Diam. | 3 |
| Matrix Vol. Heat Capacity, j/cu cm K. | 2.270 |
| Cyl. Wall Vol. Heat. Cap., j/cu cm K. | 3.590 |

-continued

| | |
|---|---|
| Therm. Cond. of Matrix Solid, w/cm K. | 0.015 |
| Therm. Cond. of Cyl. Wall, w/cm K. | 0.200 |
| Allowable Cylinder Wall Stress, psi | 30,000 |
| Hot-Cold Swept Vol. Ratio | 1 |

Based upon the above values the calculated results were:

| | |
|---|---|
| Power (Kilowatts) | |
| Basic Power | 124.9 |
| Flow Loss | 3.6 |
| Indicated Power | 121.3 |
| Shaft Power | 109.2 |
| Heat Input (Kilowatts) | |
| Basic Heat Input | 224.8 |
| Matrix Conduction | 0.8 |
| Cyl. Wall Conduction | 0.4 |
| Flow Loss Credit | −1.8 |
| Shuttle Heat Loss | 0.3 |
| Total Heat Requirement | 224.5 |
| Overall Efficiency, % | 48.6 |
| Percent of Carnot | 78.2 |

The hot plate 31 in this design presented a special problem. If the cone is thick enough to hold back the pressure then the temperature drop through its solid wall would be much too great. The problem was solved by using a thick perforated support for a thin liner. Sodium vapor would pass through the holes in the support and condense on the liner. The condensate would run back out the same holes.

The heater and cooler layers 36 and 37 in the displacer are the main points of novelty and will now be examined. In this design 80% of the heat applied to the hot space comes from the heater layer 36 and 20% directly from the hot plate 31. It is reasonable to expect that the displacer can dwell at the ends of its stroke for 1/6 of its cycle time without appreciably changing the flow rate during the rest of the cycle. Therefore, the heat flux into the heater layer 36 during the contact time would be 480 watts per square centimeter. The top and bottom centimeter of the 26.8 cm long displacer is made from sintered copper spheres of the same diameter as the underlying ceramic spheres. Because of the 3:1 height-diameter ratio of the cone, a layer of sintered copper 0.164 cm thick and 62% dense must accept and transmit the heat. The heat transmitted per cycle per square cm of cone surface is 3.33 j. The heat capacity of the copper layer is 0.407 j/K $cm^2$. Therefore the temperature swing of the heater layer 36 during the cycle is a reasonable 8.2 K.

Transient heat conduction into the sintered copper layer was evaluated. The temperature difference between the surface facing the hot plate 31 and the average temperature of the heater layer 36 was found to be 10.6 K. This was computed assuming that the thermal conductivity of the sintered copper is proportional to the volume fraction of copper in it. The temperature difference between the surface of the heater layer 36 facing the hot plate 31 and the hot plate 31 itself was evaluated in the main computer program based upon a heat balance over one cycle. The above evaluation of the heater layer 36 was done after the computer computations were finished. This evaluation shows that the heater layer 36 is practical and would change the current calculations only a small amount. In future evaluation two more nodes would be added for the heater and cooler layers. The cooler layer 37 was not evaluated, but it would be much less of a problem because its heat flux is less and its thermal conductivity is greater.

Therefore it can be concluded that a sintered copper layer as described above can function to make the engine operate approximately as presently calculated. Even though the nesting cone geometry is not very effective in isothermalizing the hot and cold gas spaces, it assists in furnishing adequate area to transfer heat to and from the heater and cooler layers 36 and 37.

Fabrication of the three-layer displacer can be less expensive than for the present tubular heaters and coolers. The heater and cooler layers 36 and 37 can be pressed and sintered from copper spheres. These two hollow cones, plus a thin stainless steel cylinder would contain the regenerator 38 made from lightly sintered ceramic spheres.

One of the big advantages claimed for this machine is its ability to employ air. If the optimized engine given above were run on air the shaft power would be reduced to 94.5 kW. and the overall efficiency would be reduced to 45.6%. On the other hand, if hydrogen were used in the engine the shaft power would be increased to 112.1 kW. and the overall efficiency would be increased to 50.1%. This engine gains its relative insensitivity to working gas by having a very low flow loss. Thus higher speeds can be employed. For instance, if the helium engine described above were operated at 3600 rpm it would have a shaft power of 196.7 kW and an overall efficiency of 46.1%.

The following table compares operational specifications of a similarly scaled United Stirling type of engine to the three element engine described in detail above. Details concerning the referenced United Stirling engine specification are from an article titled "A Technology Evaluation of the Stirling Engine for Stationary Power Generation in the 500 to 2000 Horsepower Range" by Hoagland and Percival, ORO/5392-01, September, 1978.

| | United Stirling | Three Element |
|---|---|---|
| Net Power, HP | 500 | 500 |
| Displacement/cyl., liters | 2.56 | 2.13 |
| Number of Cylinders | 4 | 4 |
| Specific power, kw/liter | 35.1 | 43.7 |
| Bore, cm | 18.2 | 20.0 |
| Stroke, cm | 10.2 | 6.8 |
| Heater Temperature, C. | 800 | 627 |
| Cooling Water Temp., C. | 30 | 67 |
| Working Gas | Helium | Helium |
| Mean Operating Pres, MPa | 14 | 13.8 |
| Speed, RPM | 850 | 1800 |
| Heating Means | Heat Pipe | Heat Pipe |
| Brake Thermal Eff., % | 44 (auxillaries) | 52 (no auxillaries) |

Figure 4:
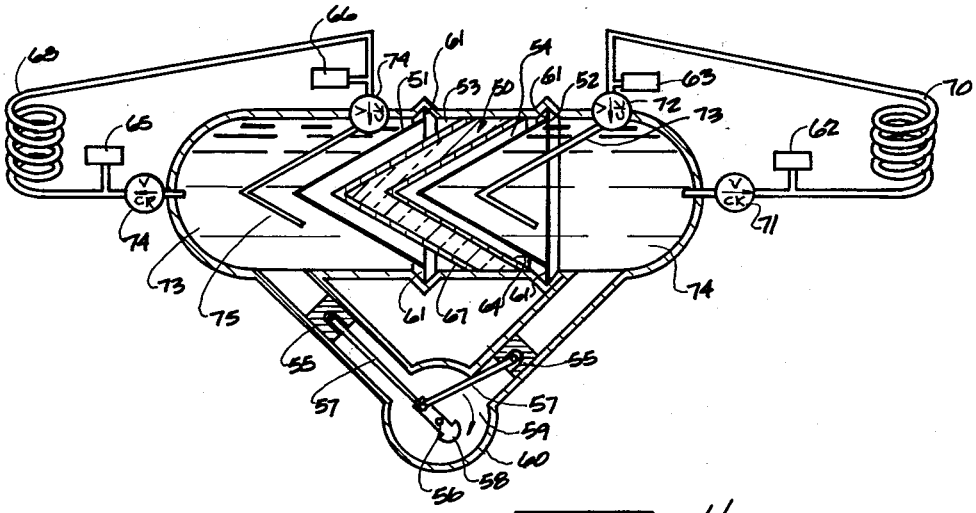
FIG. 4 is a schematic sectional view showing one physical embodiment of the invention.
Figure 5:
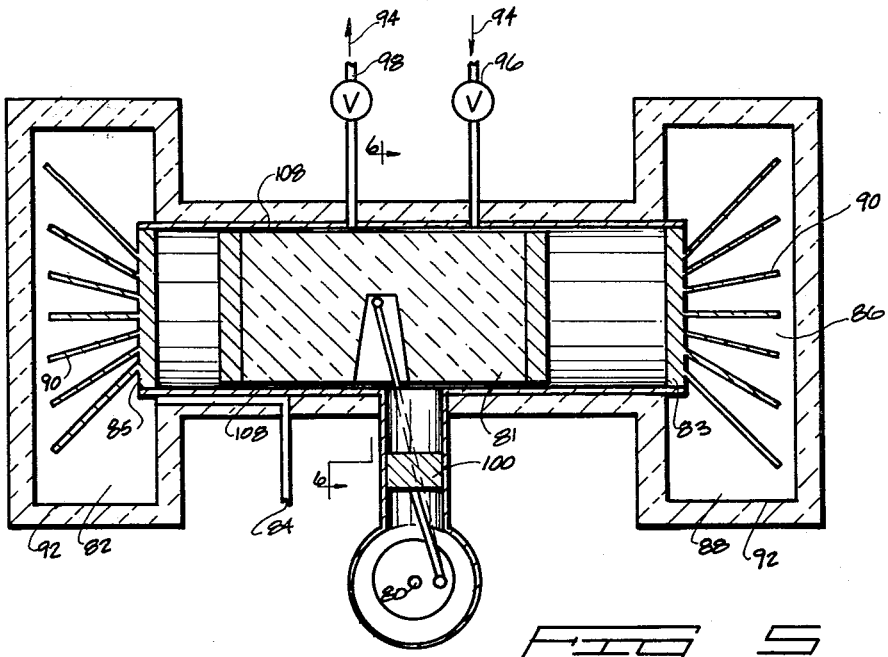
FIG. 5 is a schematic sectional view of a second embodiment.
Figure 6:
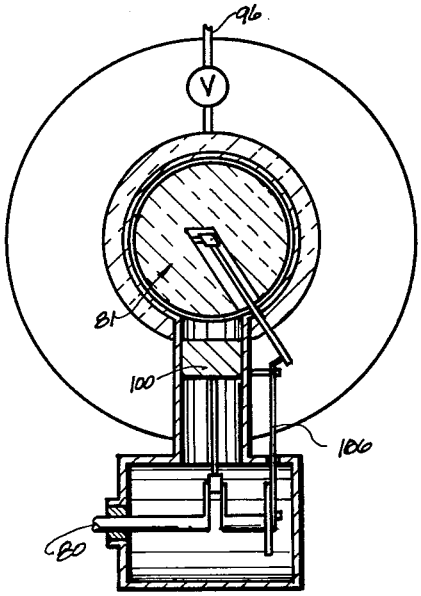
FIG. 6 is a schematic sectional view of a crank arrangement for the embodiment shown in FIG. 5.

Specific embodiments of Stirling cycle machines incorporating my invention are shown in FIGS. 4, 5, and 6. The device in FIG. 4 is a heat pump. Mechanical energy supplied to this device is converted to heat and cold. In this embodiment, the heat exchange assembly 50 is stationary and movement of the heat source surface 51 and heat sink surface 52 compresses and expands the working gas and moves it between the expansion space 53 and compression space 54. The device in FIGS. 5 and 6 is a heat pump and a heat engine. By supplying mechanical energy to the crankshaft 80, heat and cold are stored. When the mechanical energy is removed, the temperature differential between the hot and cold surfaces drives the engine crankshaft 80.

My invention can be used to pump heat (FIG. 4) by the application of shaft power. A conically shaped, stationary heat exchange assembly 50 is used in this form of my invention. The heat sink surface 52 and the heat source surface 51 are hydraulically driven by pistons 55. The two pistons 55 are connected to a single crank 56 by connecting rods 57. A counterweight 58 counterbalances the pistons 55. A motor (not shown) connected to the crank 56 drives it in a clockwise direction (arrow 59).

The heat exchange assembly 50 must operate in a pressurized gas to have a reasonable capacity. The crankcase 60 may be pressurized to reduce the bearing loads. The hydraulic links 73 and 74 at each end of the apparatus allow small diameter, long stroke pistons 55 to drive the very large diameter and very short stroke diaphragms that comprise heat sink surface 52 and heat source surface 51, respectively. Diaphragm seals 61 are used to separate the working gas from the hydraulic fluids in the two opposed hydraulic links 73 and 74. The seals 61 are backed up. Therefore, overpressure in either direction cannot ruin the seals 61 of the diaphragms. The volume of hydraulic fluid is continuously adjusted by accumulators 62 and 63 so the heat sink surface 52 just touches the cooler layer 64 of the heat exchange assembly 50. In the same way, the volume of hydraulic fluid is continuously adjusted by accumultors 65 and 66 so the heat source surface 51 just touches the heater layer 67 of the heat exchange assembly 50.

The hydraulic links 73 and 74 not only drive large diameter, short stroke diaphragms, they also make it possible to circulate a controlled amount of hydraulic fluid through external fluid loops 68 and 70. The circulation of the fluid picks up heat at a low temperature from heat sink 52 and transports it to high temperature loop 70 without going through the temperature drop of another heat exchanger.

The pistons 55 are 90° out of phase. Therefore, the action of the pistons 55 duplicates that of a rhombic drive or other Stirling machine drive mechanism. The heat source plate 51 and the heat sink plate 52 are mounted to the machine by the hydraulic seals 61. As the fluid circulates through the machine, the plates 51 and 52 move toward and away from the heat exchange assembly 50 in the Stirling thermodynamic cycle shown in FIG. 2.

As the working gas expands in expansion space 53, heat is picked up from the heat source plate 51. The movement of plate 51 forces the heated gas through the heat exchange assembly 50 into the compression space 54. As the Stirling cycle continues the gas in the compression space 54 is compressed by heat sink plate 52. As the gas is compressed, heat is transferred to the heat sink plate 52. In this manner, heat is drawn from the heat source and pumped through the heat sink. Therefore, the heat source external fluid loop 68 will become quite cold as it draws heat from its surroundings. Likewise, the heat sink external fluid loop 70 will become quite hot as it receives the heat pumped from loop 68 through the Stirling cycle heat pump.

Through the motion of the pistons 55, heat source plate 51 and heat sink plate 52 acting upon the gas surrounding the heat exchange assembly 50, the pressure of the hydraulic fluid in the hydraulic links 68 and 70 will oscillate. When the pressure increases, some fluid passes out through check valve 71 and into the hydraulic accumulator 62. The capacity of the accumulator 62, its mate 63, and the flow resistance of loop 70 will determine the amount of flow through the heat sink loop 70. The fluid enters accumulator 62 in spurts and leaves the accumulator 63 in spurts. Fluid flows nearly continuously through the heat sink coil 70. The fluid returns through the check valve 72 into an orifice spider 73, it squirts onto the heat sink 52, cooling it. Backflow of hydraulic fluid is prevented by check valve 71.

The fluid circulation process is identical in the heat source loop to that in the heat sink loop just described. In the heat source loop, fluid passes out through check valve 74 into accumulator 65. As the fluid passes through loop 68, it picks up any heat about the loop. The fluid then passes through accumulator 66 and through check valve 74 to orifice spider 75. The fluid is squirted onto the heat source plate 51 by the orifice spider 75 and plate 51 is thus heated.

A Stirling cycle heat pump has the advantage over a Rankine cycle heat pump of not being bound by the boiling and condensing properties of its working fluid. A Stirling cycle machine with little or no adjustment can operate at whatever temperature differences are available. A Stirling cycle heat pump also can be reversed to operate as a heat engine, which will reverse the direction of drive rotation.

An energy storage engine that operates between 800° Kelvin and 80° Kelvin is shown in FIGS. 5 and 6. In this engine, the Carnot efficiency of an engine operating at such a temperature range is about 90%.

The engine is run backwards by a motor (not shown) that drives crankshaft 80 at full power to liquify air in the cold temperature thermal store 82 at about 80° Kelvin. Air for this purpose comes in through the vent 84. At the same time, a light metal halide salt 86 in the high temperature thermal store 88 is melted. Heat is conducted inside both thermal stores 82 and 88 by metallic fins 90. The thermal stores are insulated with vacuum insulation 92.

After the thermal stores 82 and 88 are fully charged, as indicated by a rise in the temperature of the hot store 88, the engine will run forward. The engine is controlled by adding helium 94 (the working gas) through the line 96 to increase power and by removing helium 94 through the line 98 to reduce power. Helium is used because air would liquify and hydrogen would diffuse into and ruin the thermal insulation. Control is also possible by changing the phase between movement of the power piston 100 and the heat exchange assembly 81.

In this machine embodiment, the heat source 85 and the heat sink 83 are at inaccessible temperatures. The power piston 100 must be at an intermediate room temperature. The power piston 100 is moved by a crank 80. The heat exchange assembly 81 is moved about a pivot 100 connected to a lever 106 operated from the same crank 80, so that a 90° phase angle is realized. Two seals 108 maintained at a reasonable temperature level guide and seal the heat exchange assembly 81.

I claim:

1. A thermal regenerative machine comprising:

a vessel chamber filled with a gaseous working fluid, said chamber having a heat source surface at one end, a heat sink surface at its remaining end, and a side wall connecting the two ends;

a porous heat exchange assembly located within the vessel chamber and defining an expansion space adjacent to the heat source surface and a compression space adjacent to the heat sink surface;

means for cyclically varying the volumes of the expansion space and compression space so as to alternately expand the gaseous working fluid in the expansion space and compress the gaseous working fluid in the compression space and to further move the gaseous working fluid back and forth between the expansion space and compression space through the heat exchange assembly;

said heat exchange assembly comprising:

first thermal conductor means facing outwardly toward the heat source surface for alternately (1) receiving heat by conduction and radiation when near the heat source surface or (2) supplying heat to the gaseous working fluid either passing through the first thermal conductor means or located in the expansion space by convection and radiation;

second thermal conductor means facing outwardly toward the heat sink surface for alternately (1) transferring heat by conduction and radiation when near the heat sink surface or (2) absorbing heat from the gaseous working fluid either passing through the second thermal conductor means or located in the compression space by convection and radiation;

regenerator means interposed between said first and second thermal conductor means for thermally insulating them from one another while allowing the gaseous working fluid to move back and forth between them in a substantially thermodynamically reversible manner;

the heat storage capacity of the first thermal conductor means being adequate to supply the quantity of heat required by the gaseous working fluid in the expansion space for one cycle without substantial change in the temperature of the first thermal conductor means;

the heat storage capacity of the second thermal conductor means being adequate to absorb the quantity of heat produced by the gaseous working fluid in the compression space for one cycle without substantial change in the temperature of the second thermal conductor means.

2. A thermal regenerative machine as claimed in claim 1 wherein said means for cyclically varying the volumes of the expansion space and compression space includes means for causing the first thermal conductor means to touch or nearly touch the heat source surface for a dwell time sufficient to cause the two to equilibriate in temperature and to restore to the first thermal conductor means the net heat loss to the gaseous working fluid which occurs during one cycle and for alternately causing the second thermal conductor means to touch or nearly touch the heat sink surface for a dwell time sufficient to cause the two to equilibriate in temperature and to transfer from the second thermal conductor means the net heat gain from the gaseous working fluid which occurs during one cycle.

3. A thermal regenerative machine as claimed in claim 1 wherein each of said first and second thermal conductor means comprises a structure having a high surface-to-volume ratio to facilitate heat transfer between it and the gaseous working fluid, good longitudinal thermal conductivity oriented between the ends of the vessel chamber, evenly distributed porosity, and low gaseous flow resistance.

4. A thermal regenerative machine as claimed in claim 1 wherein said first thermal conductor means comprises a layer of interconnected metal particles.

5. A thermal regenerative machine as claimed in claim 1 wherein said second thermal conductor means comprises a layer of interconnected metal particles.

6. A thermal regenerative machine as claimed in claim 1 wherein the regenerator means comprises a structure having a high surface-to-volume ratio to facilitate heat transfer between it and the gaseous working fluid, poor longitudinal thermal conductivity between the first and second thermal conductor means, evenly distributed porosity and low gaseous flow resistance.

7. A thermal regenerative machine as claimed in claim 1 wherein the regenerator means comprises a porous ceramic layer.

* * * * *